US006182309B1

(12) United States Patent
Sullivan

(10) Patent No.: US 6,182,309 B1
(45) Date of Patent: Feb. 6, 2001

(54) BEACH TOWEL-PILLOW APPARATUS

(75) Inventor: William Sullivan, San Tecla (SV)

(73) Assignee: Fashion Towel Imports Corp.

( * ) Notice: Under 35 U.S.C. 154(b), the term of this patent shall be extended for 0 days.

(21) Appl. No.: 09/321,179

(22) Filed: May 27, 1999

(51) Int. Cl.[7] ..... A47G 9/06
(52) U.S. Cl. ..... 5/419; 5/490
(58) Field of Search ..... 5/417, 419, 490

(56) References Cited

U.S. PATENT DOCUMENTS

| | | | | |
|---|---|---|---|---|
| D. 258,035 | | 1/1981 | Fenwick . | |
| 1,222,563 | | 4/1917 | Rosenberg . | |
| 2,264,471 | | 12/1941 | Glenn . | |
| 3,082,437 | | 3/1963 | Upthagrove . | |
| 3,241,161 | | 3/1966 | Dashosh . | |
| 4,195,378 | | 4/1980 | Parker . | |
| 5,010,610 | | 4/1991 | Ackley . | |
| 5,199,120 | * | 4/1993 | Holmes | 5/419 |
| 5,361,435 | * | 11/1994 | Reeves | 5/419 |
| 5,435,025 | * | 7/1995 | Gerard et al. | 5/419 |
| 5,467,487 | * | 11/1995 | Sicard | 5/419 |
| 5,629,071 | * | 5/1997 | Feldman | 5/419 X |
| 5,729,846 | * | 3/1998 | Sullivan | 5/419 |

* cited by examiner

*Primary Examiner*—Michael F. Trettel
(74) *Attorney, Agent, or Firm*—Malin, Haley & DiMaggio, P.A.

(57) ABSTRACT

A beach towel-pillow apparatus allowing a user to rest comfortably on a beach towel while his or her head is supported by a cylindrically-shaped pillow, permanently affixed to one end of the towel portion of the apparatus. One or more elastic securing straps are affixed to one end of the apparatus and are used to secure the towel portion when it is wrapped around the pillow thereby allowing for easy storage and transporting of the apparatus. An adjustable carrying strap, much like a belt, is affixed to one end of the pillow allowing for a user to sling the carrying strap over his or her shoulder for easy carrying of the apparatus once the towel has been secured around the pillow by the securing straps. A pillow covering with a zipper hidden from view by a portion of the covering encloses the pillow, allowing for easy insertion and removal of the pillow.

2 Claims, 2 Drawing Sheets

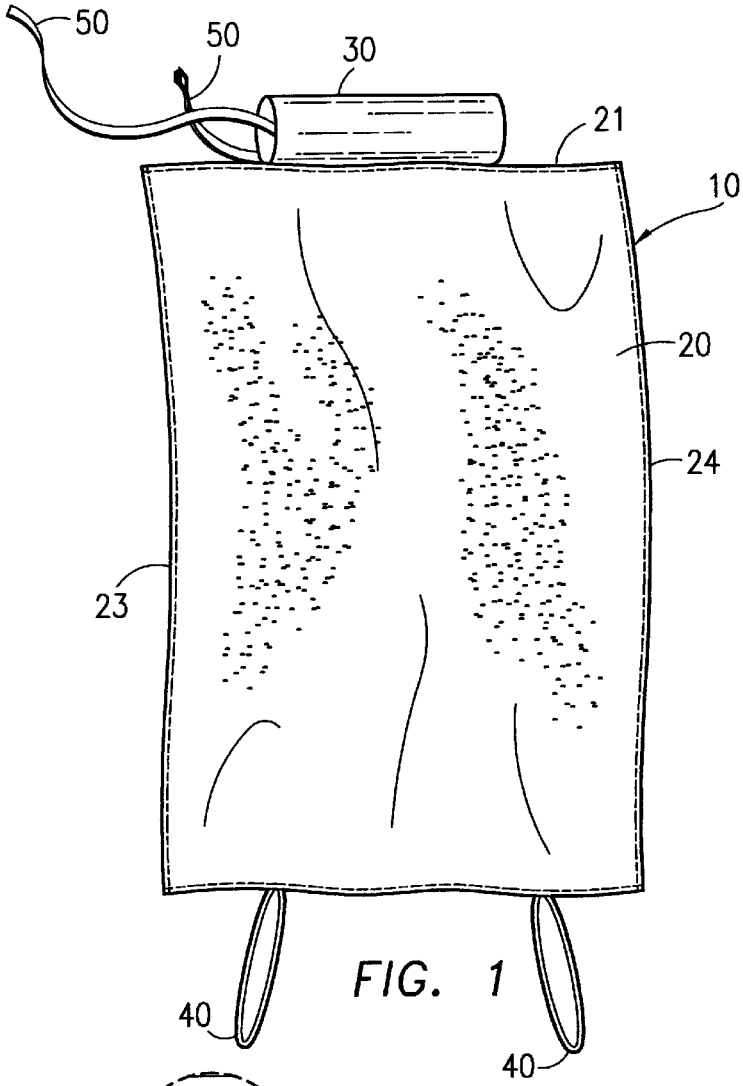
FIG. 1
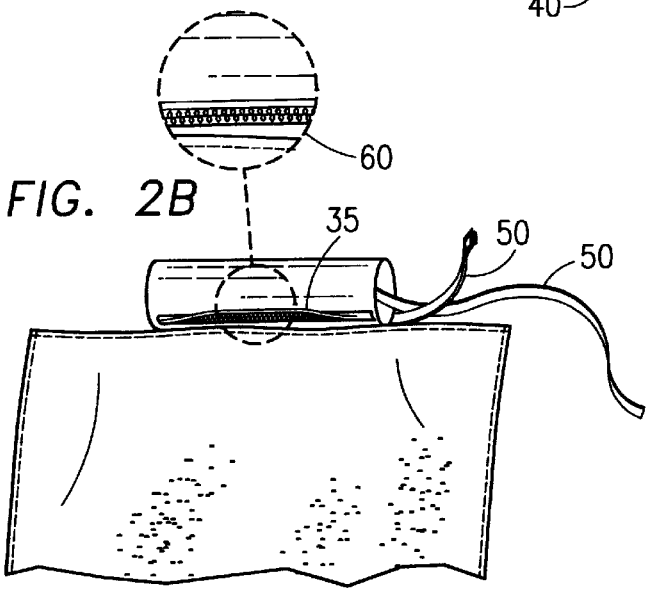
FIG. 2B
FIG. 2A
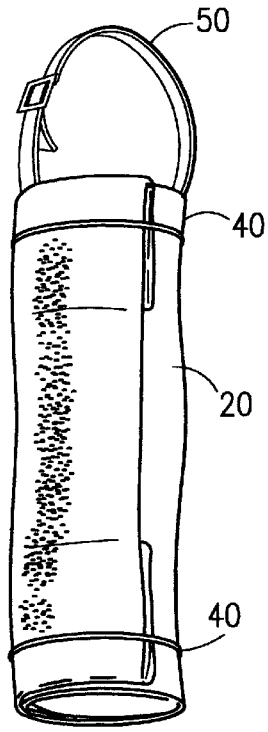
FIG. 3

BEACH TOWEL-PILLOW APPARATUS

BACKGROUND OF THE INVENTION

1. Field of the Invention

The present invention relates to a pillow with an attached towel and more specifically to a portable beach towel with a cylindrical pillow attached to one end of the towel, for use at the beach or poolside and with elastic securing straps and a carrying strap thereby allowing the device to be stored and transported easily.

2. Description of Related Art

At the beach or pool, it is often a common site to see people laying prone upon a beach towel, whether it be on the concrete edge of a pool or on the sand. Many beach or pool-goers that enjoy reading or observing of the surrounding are attempt to elevate their head by resting it upon a beach bag, a towel, or other bulky item. However, because it is generally uncomfortable to lay on a beach towel with a bulky head support, the insertion or inclusion of a head support in the form of a pillow has become very popular.

Instead of folding up another towel, or positioning a beach bag beneath the user's head, a combination beach towel-pillow allows for a user to rest comfortably upon a towel while elevating their, thereby allowing them to read, keep an eye on their children, or simply to rest comfortably.

Many devices utilize cushions positioned directly on top of a towel. Other devices are utilized by rolling a portion of the towel forward creating a pocket in order to accommodate a cylindrical pillow which is inserted into the pocket created.

U.S. Pat. No. 5,361,435 issued to Reeves discloses a portable beach towel with a built-in, hidden security pouch for storing valuables. An elastic carrying strap and a pair of elastic loops or situated at one end of an elongated towel. The opposite end is folded inward over the top surface of the towel forming an enclosure space into which a rod-shaped pillow is inserted. Reeves requires a portion of the towel to be folded over itself to create a pocket for the insertion of the pillow.

U.S. Pat. No. 4,195,378 issued to Parker discloses a beach towel with sealable pockets at one end. One of the pockets is sufficiently large to accept soft, bulky material, which acts as a pillow.

U.S. Pat. No. 3,241,161 issued to Dashosh discloses a blanket cover which includes a zippered closing means, with a pleat concealing it, thereby forming an enclosure.

U.S. Pat. No. 3,082,437 issued to Upthagrove discloses a novelty beach mat which includes a pad superimposed on top of the beach mat. The pad comprises a specially delineated pattern which can represent a particular figure such as that of an animal. The animal's is actually an upwardly protruding pouch which, when stored with items, and positioned in a predetermined manner, acts as a pillow.

U.S. Pat. No. 2,264,471 issued to Glenn discloses a beach blanket with spaced pockets at one end to hold money, cigarettes or other small items. The pockets are closed by zipper fasteners. A lining having fastener elements are included to secure the lining to a base layer.

U.S. Pat. No. 1,222,563 issued to Rosenberg discloses an elongated mat with a pneumatic cushion with a valved tube situated directly on the mat and at one end of the mat whereby the valved tube can be used to inflate or deflate the cushion. The pneumatic cushion is secured to the mat via securing straps.

U.S. Pat. No. Des.258,035 issued to Fenwick is a design patent featuring a beach blanket with a storage pocket.

None of the prior art devices, however, disclose a combination beach towel-pillow that comprises a pillow with a towel portion permanently affixed at one of its ends. The combining of a towel and pillow in one apparatus allows the user to simply unfold the apparatus, roll out the towel portion, use the device, and when complete, roll-up the towel again while securing it around the towel with elastic securing straps for quick and easy transport and storage.

BRIEF SUMMARY OF THE INVENTION

The present invention relates to a beach towel with an attached pillow for use at the beach or pool and more specifically, a beach towel-pillow apparatus comprising an elongated towel portion having opposing first and second ends, opposing sides, a top and bottom surface and a pillow, preferably cylindrically-shaped, affixed to the first end of said towel.

In an alternate embodiment, one or more elastic securing straps are affixed to the first or second end of the towel thereby securing the towel around the pillow when the pillow-towel apparatus is stored or being transported.

In an alternate embodiment, an adjustable carrying strap affixed to the pillow allows the beach-towel apparatus to be easily transported.

The pillow further includes a pillow covering protecting the pillow from debris and a zipper allowing for easy insertion and removal of the pillow, wherein the zipper is hidden from sight by a portion of the pillow covering.

It is an object of this invention to provide a beach towel with a permanently affixed pillow which allows a user to rest his or her head comfortably upon the pillow while laying upon the surface of the beach towel.

It is another object of this invention to provide a beach towel-pillow apparatus that does not have separate components but instead combines the pillow and beach towel in one device.

It is yet another object of this invention to provide a beach towel-pillow apparatus with elastic straps which secures the towel around the pillow in a rolled-up configuration when the apparatus is not in use, and a carrying strap to help facilitate transportation of the beach towel-pillow apparatus.

In accordance with these and other objects which will become apparent hereinafter, the instant invention will now be described with particular reference to the accompanying drawings.

BRIEF DESCRIPTION OF THE SEVERAL VIEWS OF THE DRAWINGS

FIG. 1 is a top view of the beach towel-pillow apparatus 10.

FIG. 2A shows a back view of the beach towel-pillow apparatus showing the zipper 60 along the longitudinal surface of the pillow 30.

FIG. 2B shows a close-up view of the zipper 60.

FIG. 3 shows the beach towel-pillow apparatus in a rolled-up configuration with elastic straps 40 wrapped around towel 20.

DETAILED DESCRIPTION OF THE INVENTION

Figure 4:
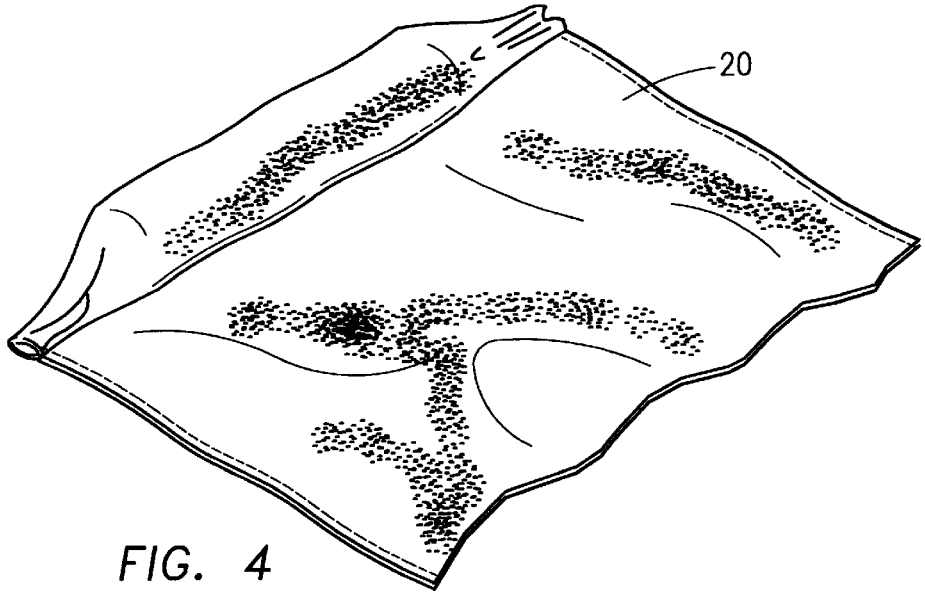
FIG. 4 shows the towel 20 folded over the pillow to allow the user to rest his or her head upon the towel with the pillow enclosed therein.
Figure 5:
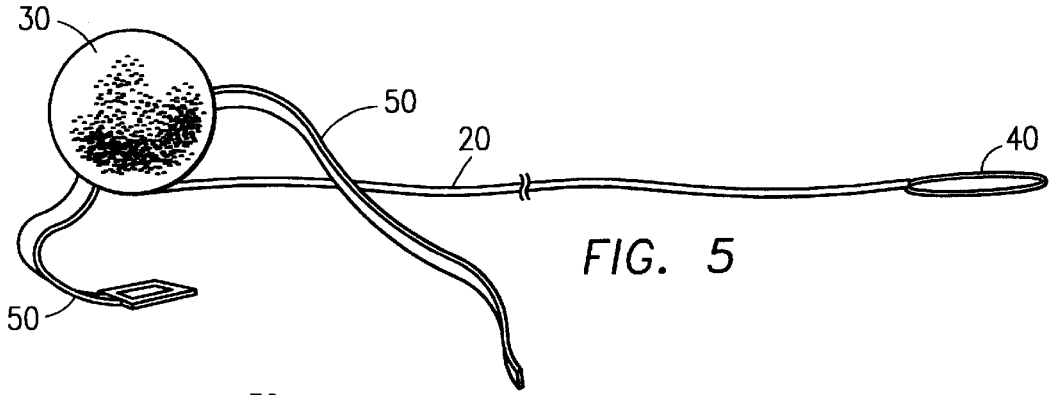
FIG. 5 is a side view of the beach towel-pillow apparatus 10.
Figure 6:
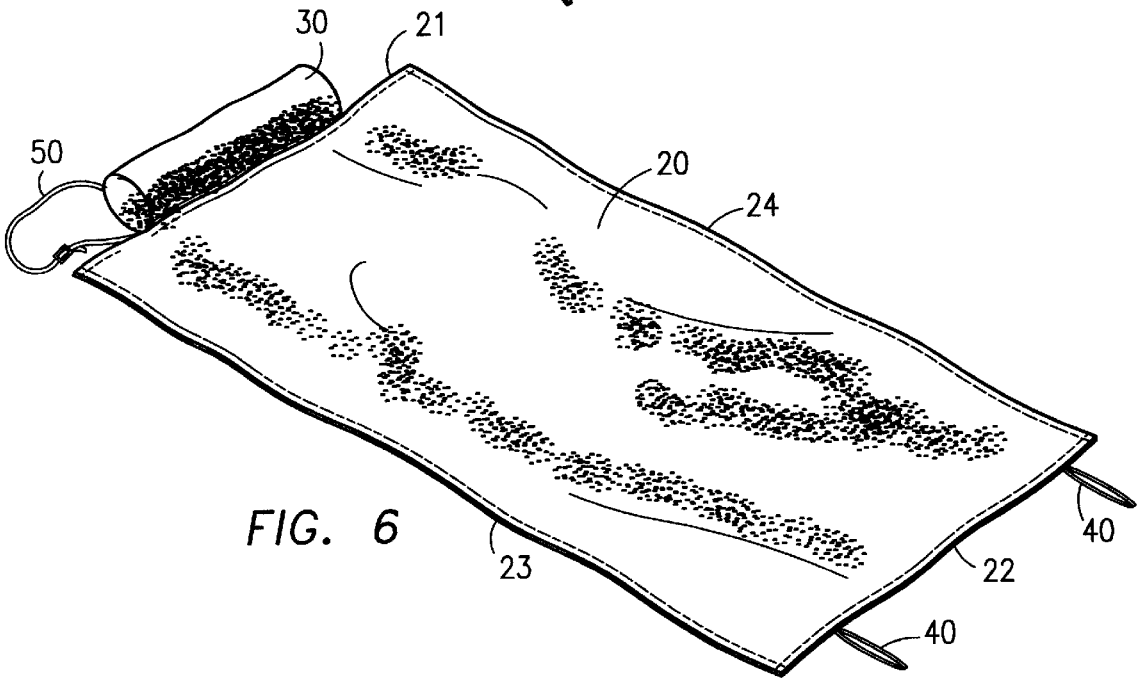
FIG. 6 is a perspective view of the beach towel-pillow apparatus 10.

Turning now to the drawings, FIG. 1 schematically illustrates the beach towel-pillow apparatus of the present invention, generally referenced as 10. The apparatus includes a an elongated towel portion 20, a pillow 30, preferably of a cylindrical shape, one or more elastic securing straps 40, a carrying strap 50, and a zipper 60 along the length of the pillow 30.

Referring specifically to FIG. 1, a beach towel 20 of a substantially rectangular shape has opposing substantially parallel first 21 and second 22 ends and opposing substantially longitudinal edges 23 and 24. The towel 20 is of the ordinary variety, and ordinary fabric. Affixed to the first end 21 of the towel 20 is a cylindrically-shaped pillow 30. Although any shaped pillow can be used, the preferred embodiment of the present invention includes a substantially-cylindrically shaped pillow. The length of the pillow 30 is generally less than the length of the end of the towel 20, as can be seen clearly in FIG. 1. A number of different configurations are possible including a pillow with a length greater than the length of the end of the towel to which it is affixed. However, the advantage of the preferred embodiment as shown in FIG. 1 is that a towel with ends greater in length than that of the pillow can be wrapped around the pillow, thereby enclosing the ends of the pillow, shielding it from sand or debris. This can be seen more clearly in FIG. 4.

In FIG. 1, a pair of carrying straps 50 can be seen protruding from one end of pillow 30. The carrying straps are used to easily transport the apparatus, as can be seen in FIG. 3, yet do not interfere with the user when the apparatus is in use.

FIG. 3 shows how the apparatus 10 appears when not in use, with the carrying straps 50 interlocked in the same manner as a belt buckle would interlock. The carrying straps form an adjustable loop which can adjusted to fit around a user's waist, be slung over the user's shoulder or be carried by hand. Elastic straps 40 are affixed to an end of the towel portion 20 and are used to encircle the towel 20 thereby keeping the towel 20 secured about the pillow 30, in a snug, cylindrical configuration, facilitating the storing and transferring of the apparatus.

In the preferred embodiment, a pillow covering 35 surrounds the entire pillow 30, protecting it from debris. A zipper 60 runs along the length of pillow 30. A portion of the covering 35 overlaps the zipper 60, thereby hiding it from view. This can be seen in FIG. 2A. The purpose of the zipper is to allow the pillow 30 to be removed from the covering which encloses it, for the purpose of cleaning the covering 35, and for the reinserting of the pillow 30.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A beach towel-pillow apparatus comprising:

an elongated towel portion having opposing first and second ends, opposing sides, and a top and bottom surface;

a pillow affixed to said first end of said towel thereby forming a one-piece towel-pillow combination allowing a user to rest his or her head comfortably upon said pillow while simultaneously reclining on said towel portion;

said pillow is sized to have a length less than the width of said towel portion;

an adjustable carrying strap affixed to an end of said pillow allowing said beach towel-pillow apparatus to be easily transported;

said pillow further includes a pillow covering thereby protecting said pillow from debris, said pillow covering includes a zipper situated longitudinally along said pillow proximate the bottom surface of said towel portion allowing for easy insertion and removal of said pillow wherein said zipper is hidden from view by a portion of said pillow covering and due to its location proximate said towel portion's bottom surface.

2. A beach towel-pillow apparatus comprising:

an elongated towel portion having opposing first and second ends, opposing sides, and a top and bottom surface;

a cylindrically-shaped pillow affixed to said first end of said towel thereby forming a one-piece towel-pillow combination allowing a user to rest his or her head comfortably upon said pillow while simultaneously reclining on said towel portion, wherein said pillow further includes a pillow covering thereby protecting said pillow from debris;

said pillow having a length less than the width of said towel portion;

said pillow covering includes a zipper situated longitudinally along said pillow proximate the bottom surface of said towel portion allowing for easy insertion and removal of said pillow wherein said zipper is hidden from view by a portion of said pillow covering and due to its location proximate said towel portion's bottom surface;

one or more elastic securing straps affixed to said first or second end of said towel thereby securing said towel around said pillow when said beach towel-pillow apparatus is not in use; and an adjustable carrying strap affixed to an end of said pillow allowing said beach towel-pillow apparatus to be easily transported.

* * * * *